United States Patent [19]

Geiger

[11] 4,387,821

[45] Jun. 14, 1983

[54] STOPPING DEVICE FOR BOTTLE

[75] Inventor: Reinold Geiger, Neuilly, France

[73] Assignee: A.M.S. (Ateliers de Moulage Specialise), Saint-Ouen, France

[21] Appl. No.: 212,440

[22] Filed: Dec. 3, 1980

[30] Foreign Application Priority Data

Dec. 20, 1979 [FR] France ..... 79 31317

[51] Int. Cl.[3] ..... B65D 41/06

[52] U.S. Cl. ..... 215/330; 215/332

[58] Field of Search ..... 215/332, 330, 331, 334

[56] References Cited

U.S. PATENT DOCUMENTS

| | | | |
|---|---|---|---|
| 495,299 | 4/1893 | Calcutt | 215/330 |
| 1,538,848 | 5/1925 | Dunnock | 215/332 |
| 1,977,589 | 10/1934 | Merolle | 215/330 |
| 2,270,424 | 1/1942 | Fabrice | 215/332 |
| 3,809,276 | 5/1974 | Landen | 215/332 |
| 3,927,783 | 12/1975 | Bogert | 215/332 X |
| 4,230,232 | 10/1980 | Atkins | 215/330 |
| 4,257,526 | 3/1981 | Weits et al. | 215/332 |
| 4,271,974 | 6/1981 | Quinard | 215/331 |
| 4,273,248 | 6/1981 | Lehmann | 215/331 |

FOREIGN PATENT DOCUMENTS

| | | | |
|---|---|---|---|
| 461956 | 2/1951 | Italy | 215/332 |

*Primary Examiner*—Donald F. Norton

*Attorney, Agent, or Firm*—Sandler & Greenblum

[57] ABSTRACT

A stopping device intended particularly for fitting a bottle having a body without symmetry of revolution with a stopping element also without symmetry of revolution, in such a way that the latter, in the stopping up position, has a predetermined orientation relative to the bottle.

It comprises stopping means providing omnidirectional obturation in form of an elastic cylindrical skirt insertable frictionally into the throat of the bottle, means for axial and angular positioning of the stopping element, in form of projections or lugs on the stopping element, insertable through elastic deformation into lodgings formed on the bottle in a predetermined angular position, the configurational cooperation of the projections and lodgings ensuring univocal angular orientation of the stopping element and its holding in the axial position on the bottle.

12 Claims, 3 Drawing Figures

STOPPING DEVICE FOR BOTTLE

The invention relates to stoppers for bottles or flasks for conditioning cosmetic, pharmaceutical or food products. It applies advantageously to stoppers of the decorative type, for scent bottles or beauty product bottles.

The appearance of conditioning means for some products, in particular, perfumes, is of very great commercial importance. For each product a particular conditioning is designed, the shapes, proportions, and colors of which are determined by specialists.

Some of such conditionings have recourse to a bottle with a cylindrical neck and to a stopper the configuration of which has no symmetry of revolution, and which in the stopping condition are mounted in a predetermined manner so as to participate in the general attractiveness of the conditioning. For example, if a flask with a flat body is dealt with, it may be desired to fit it with a stopper also of a flat shape, such that the main plane of the latter is parallel to the main plane of the bottle. To this end, means must be provided to ensure angular orientation of the stopper in respect to the bottle. Concerning this, it is intended that the stopper orientation be effected automatically, i.e. without the user's taking special measures for obtaining correct orientation each time the bottle is being stopped up.

The simplest solution was heretofore using a stopper screwed on the neck, with the length and pitch of the threading being calculated so that the desired orientation is obtained when the stopper is totally screwed on, thereby ensuring the forceful application of sealing means comprised thereby, usually a block of resilient material mounted on the bottom of the stopper, against the annular rim of the bottle throat. This solution is not satisfactory, since the angular positioning of the totally screwed on stopper varies after several utilizations thereof, due to the manufacturing tolerances for the stopper and the neck, and to permanent deformations in the sealing block fitted in the stopper, and thus, the desired attractiveness is cancelled.

To obviate such drawback, there has been proposed to equip the stopper with an abutment that comes at the end of the screwing to bear against a counter-abutment formed on the bottle, either in the region of its neck or in a region more remote from the screwing axis, for example, on the body of the bottle. Thus, there can be obtained satisfactory angular positioning of the stopper, but in return, since the completed screwing position is predetermined, a forceful application of the sealing portion is not reached when the dimensions thereof vary, due to manufacturing tolerances and possible deformations resulting from repeated utilizations.

In order to improve accuracy of the final orientation of the screwed on stoppers, there has been proposed to use screwings with a so-called "quick" pitch, i.e. having a single high pitch threading, and to provide an abutment at the end of the threading. Although better results are obtained in this way, as compared to screwings with the usual pitches, the desired accuracy and reliability are however not achieved.

Finally, the quality of the results in all the proposed solutions up to now depends on the manufacturing accuracy of the screw thread, of any kind, formed on the throat of the bottle. Any angular offsetting of the screw thread with respect to its theoretical position results in an angular offsetting of the stopper, which beyond a certain amplitude cancels the desired aesthetic effect. Now, admissible tolerances in glassmaking industry leave often room for such angular offsetting.

One object of this invention is to provide such a stopping device which permits simultaneous realization of the functions of stopping, and angular orientation and holding in place of the stopper.

Another object of the invention is to provide a simple stopping device, easy to manufacture and composed of a few elements, while actuation thereof is particularly easy.

These objects are achieved in accordance with the invention thanks to the facts that the sealing means, of the omnidirectional obturation type, are efficient, to a great extent, independently of the relative axial position of the stopper with respect to the bottle throat portion and of the holding force maintaining the stopper on the neck, while other means are provided to ensure, by configurational cooperation, the angular orientation of the stopper and its holding on the bottle neck.

The stopping device according to the invention, which is intended for fitting a bottle having a body without symmetry of revolution, with a stopper also without symmetry of revolution, in such a way that the latter in the stopping up position has a predetermined orientation with respect to the bottle, is characterized in that the stopper comprises a supple cylindrical portion suitable for introduction slightly by force into the throat portion to procure the required tightness on the one hand, and on the other hand, the stopper comprises projections on a portion thereof suitable for capping the neck, such projections being insertable by elastic deformation into lodgings formed on the neck, or reversely, the configurational cooperation of the projections and lodgings ensuring univocally and with no bearing of the stopping efforts, the angular orientation of the stopper and its holding in position on the bottle.

In a preferred form of embodiment of the invention, the stopping device consists of a stopper having the above-defined characteristics and comprising a cylindrical outer mantle on which is mounted a cap of external dissymmetrical shape and having a cylindric bore therein for cooperation with the stopper by tight fitting thereon. The periphery of the stopper may be smooth or formed with grooves parallel to its axis to facilitate fitting thereof in the cap the bore of which may also have grooves therein parallel to its axis.

The invention will be described hereinafter in an exemplifying form of embodiment with reference to the attached drawing, in which.

Figure 1:
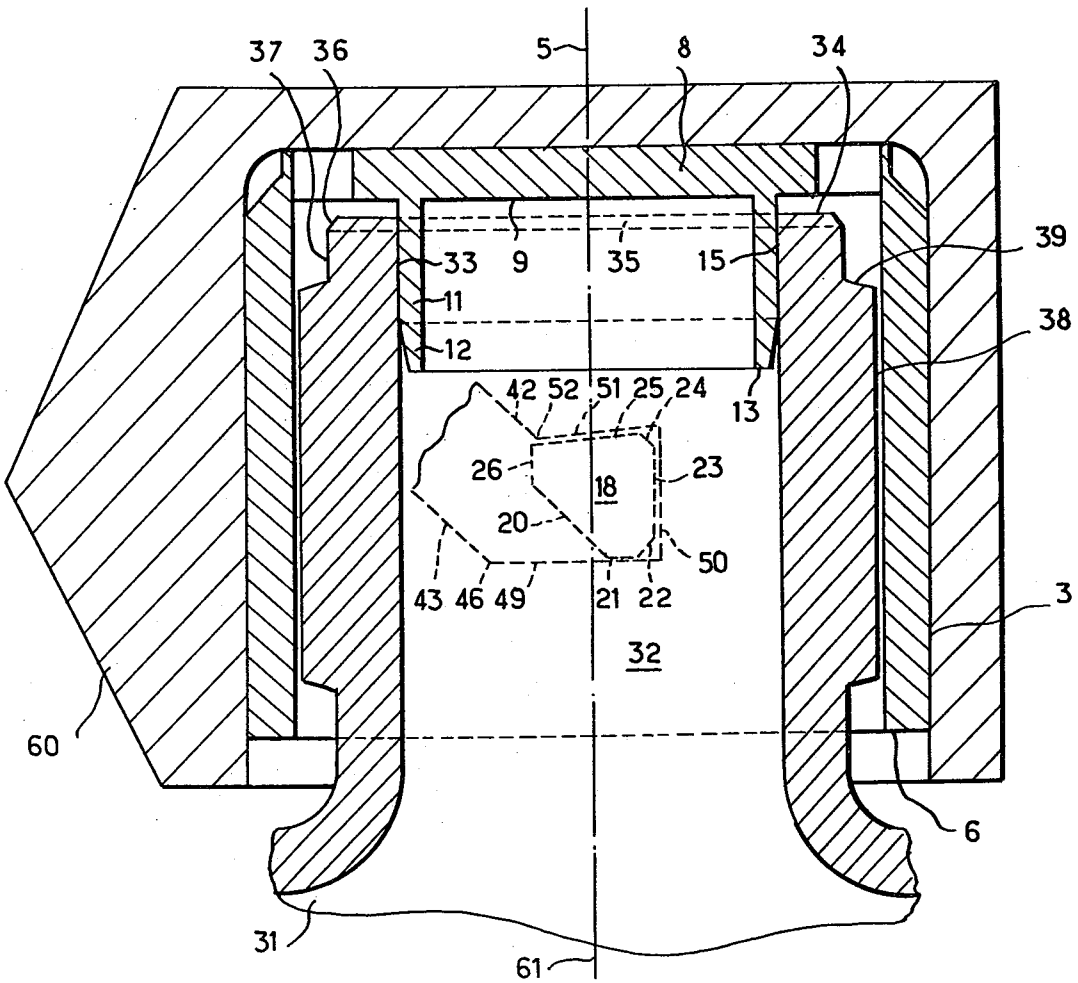
FIG. 1 is a sectional view of a bottle neck provided with a stopper.
Figure 2:
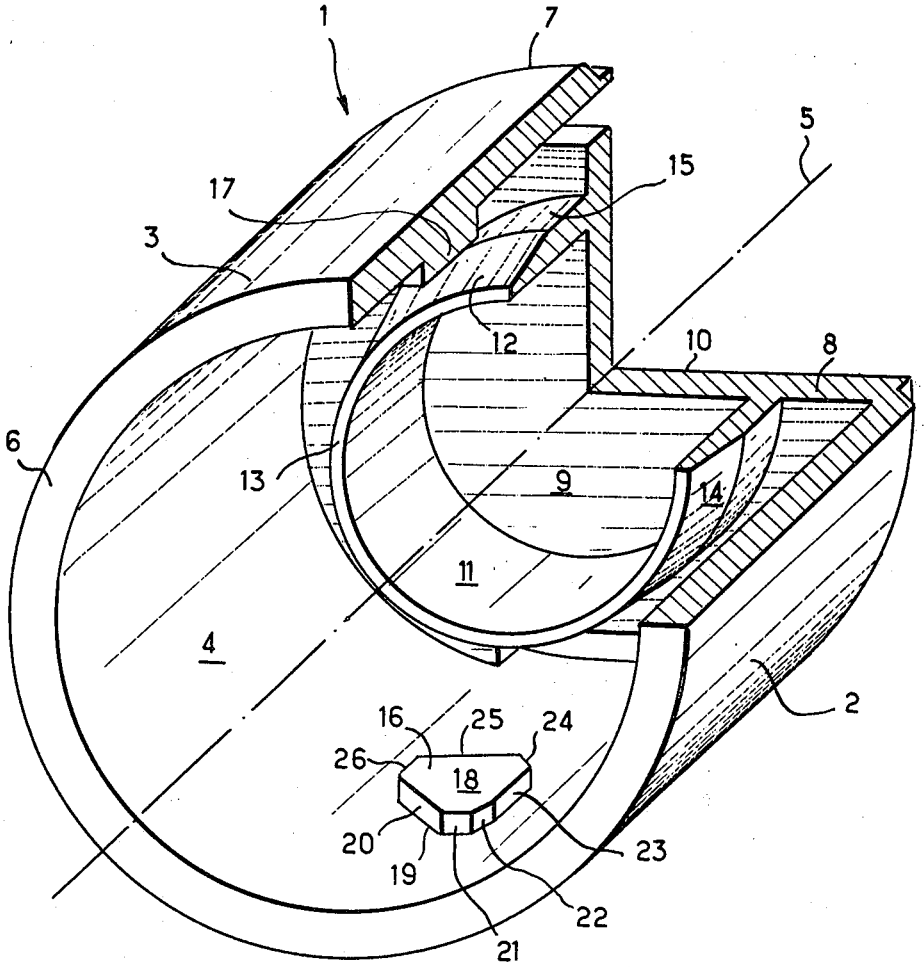
FIG. 2 is a perspective view partly in section of the stopper of FIG. 1.

The stopper 1 (FIG. 2) of the stopping device according to the invention consists of a cylindrical hollow body 2 having an outer mantle 3 and an inner mantle 4 concentrical with one another and having an axis 5. The stopper 1 carries signs, patterns or elements, for example, a stopper cap 60 (FIG. 1) permitting the handling and having no symmetry of revolution with respect to axis 5, and for which an angular orientation in respect to the bottle is desired; the cap 60 formed with a cylindrical bore therein is fitted tightly on the outer mantle 3 of the stopper 1. In another form of embodiment, the cap and the stopper may be formed in a single piece. The end 6 of body 2 is left free, whereas the opposite end 7 is closed up by a radial wall 8 having inner 9 and outer 10 parallel faces. Face 9 perpendicular to the axis 5 carries a cylindrical elastic skirt 11 having an axis 5 and disposed at a distance from the mantle 4. In the vicinity of the free end 13 of the skirt, the outer mantle 12 of the skirt 11 comprises a zone 14 tapering conically toward the end 13. The zone 15 of the outer mantle 12 of the skirt, which is located between the zone 14 and the wall 9, has a definite diameter slightly higher than the diameter of the bottle throat which must be fitted with the stopper. The height of the skirt 11 is lower than the height of the body 2.

In the zone delimited by the plane through the end 13 of the skirt 11 and the plane through the end 6 of the body 2, the inner mantle 4 of the body 2 carries two radial diametrically opposite prismatic lugs 16 and 17. These lugs comprise a face 18 substantially concentric with the mantle 4 and a convex polygonal contour 19 having successive planar facets 20,21,22,23,24,25 and 26 substantially orthogonal with respect to the mantle 14 and the face 18. The facets 23 and 26 are parallel to the axis 5 of the stopper; facet 21 is perpendicular thereto and facets 20,22,24 and 25 are variously inclined.

The stopper 1, made in a single piece, is of a plastics material of the elastic type.

Figure 3:
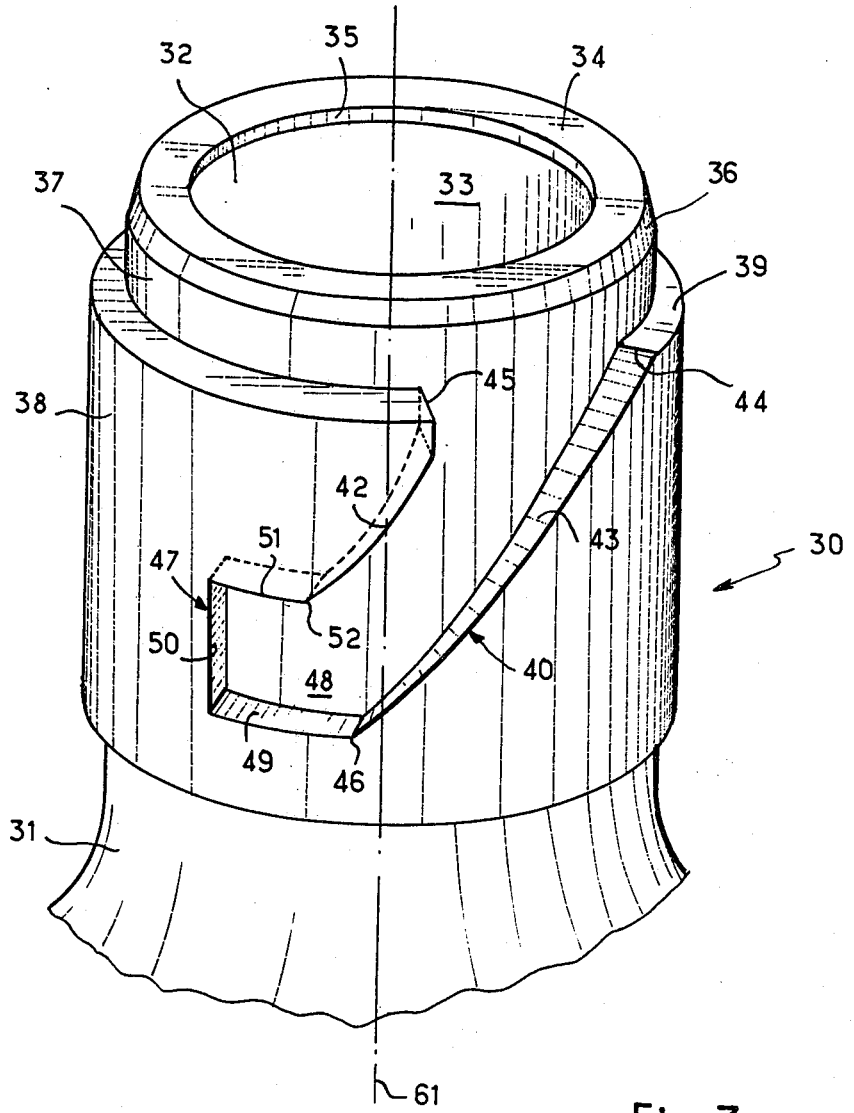
FIG. 3 is a perspective view of the bottle neck of FIG. 1.

The bottle 31 (FIG. 3), which must be fitted with the abovedescribed stopper, has no symmetry of revolution; it comprises a substantially cylindrical neck formed with a throat portion 32 having an inner mantle 33. The rim 34 of the throat comprises an inner beveled portion 35 and an outer beveled portion 36. The upper zone of the mantle 33, close to the beveled portion 35, has a predetermined diameter which may be obtained in the glassmaking industry with manufacturing tolerances closer than those for the other portions of the neck.

The outer cylindrical mantle 37 of the neck 30 carries an annular ring 38 having an axis 61 and limited by a radial edge portion 39 close to the beveled portion 36. The ring 38 can be mounted on the neck or made in a single piece therewith on manufacturing the bottle. The ring 38 is formed with two grooves 40 only one of which is shown on FIG. 3, configured substantially as high pitch spiral portions interrupting the edge 39. The groove 40 can compare with a female high pitch screw threading. The groove 40 is bordered by radial edges 42 and 43 connected to the ends 44 and 45 of the edge portion 39. The interval delimited by the ends 44 and 45 of the edge 39 constitutes the inlet to the groove 40. At its other end 46 the groove 40 opens into a lodging 47 cut in the ring 38. The mantle 37 is made as a bottom portion 48 for the window 47 and the notch 40. The lodging 47 is limited by three planar edge portions 49,50 and 51 perpendicular to the mantle 37. The edge 49 located at the end of the flange 43 is substantially orthogonal with respect to the axis 61 of the throat, whereas the edge 51 extending the flange 42 moves up slightly toward the edge 39 from the end 52 of the flange 42. The edge 50 which connects those ends turned away from the flanges 42 and 43, respectively, of edge portions 49 and 51 is substantially parallel to the throat axis.

The stopping device according to the invention is used as follows:

The stopper 1 is placed coaxially of the neck 30 on the bottle. The body 2 covers the neck. The facets 21 of lugs 16,17 are brought into contact with the edge portion 39 of the ring 38. With the stopper being rotated about its axis 5, the facets 21 reach the ends 44 or 45 of the edge portion 39, thereby permitting the lugs 16 and 17 to be inserted into the grooves 40 of the ring. The inclined facets 20,24 of the lugs then play the role of portions of a male thread cooperating with the female threads constituted by the flanges 42,43 of the grooves 40. The lugs being continuously moved into the grooves by screwing the stopper on, the skirt 11 is inserted into the throat 32 through cooperation of its conical portion 14 with the beveled portion 35 of the throat. During the screwing, the conical portion 14 and then the cylindrical portion 15 of the skirt are introduced into the throat and the latter cooperates radially slightly by force with the mantle 33. This operation seals the bottle tightly without requiring any accurate axial positioning of the stopper relative to the bottle neck.

At the end of the screwing, the facets 21 of the lugs come into contact with the edge portions 49 of the lodgings 47, thereby to limit axial movement of the stopper with respect to the neck. Additional rotation of the stopper in the same direction as previously causes application of the facets 24 of the lug against the end 52 common to the flange 42 and to the edge portion 51 and which constitutes a "hard point". The facet 24 crosses such hard point by elastic deformation of the lug which applies itself moreover on edge portion 49 by its facet 21. After crossing such point the lug is inserted into the lodging by final rotation of the stopper, until abutment of facet 23 of the lug against the edge portion 50 of the ring. The slope of the facet 25 of the lug being substantially equal to that of the edge portion 51 of the lodging, and the dimensions of the lug being slightly higher than those of the lodging, said lug is positively locked into the lodging, abutting against the edge portion 50 by configurational cooperation and wedging effect of the facet 25 and the edge 51. The balanced position of the lugs in the lodgings is univocal and is not subject to variations caused for example by wear, since those elements are not submitted to the forces ensuring the tightness.

In the final position of the stopper, the facet 23 of the lug and the edge portion 50 of the lodging are urged to one another only by the wedging effect, thereby ensuring accurate angular orientation of the stopper in respect to the bottle.

In the factory, to obtain perfect angular orientation of the stopping device on the bottle, in accordance with one aspect of the invention, the stopper 1 is first mounted in the closing position on the bottle, and then, the cap 60 is fitted stiffly on the stopper 1, while being perfectly oriented relative to the bottle body. In this way, any possible angular offsetting of the bottle neck elements resulting from the existing manufacturing tolerances in glassmaking industry, which would inevitably influence the angular orientation of the stopper, is definitely coped with so as to obtain the final positioning of the cap. Such operation consisting of preliminarily mounting the stopper on the bottle and then of stiffly fitting the cap on the stopper can be easily automatized in a bottling production line.

With this preferred form of embodiment of the invention, it is no longer required to accurately orient the positioning means provided on the bottle neck, as the terminal orientation of the device is ensured by fitting the cap on the stopper, thereby greatly facilitating the fabrication of the bottle in glassworks.

It may be noted that in the stopping device according to the invention the function of orientation and holding in position of the stopper is exclusively ensured by the play of the lugs and lodgings and that the tightness of the bottle closure results from insertion of the skirt into the throat, independently of the orientation of the stopper. Finally, it may be noted that the edge 34 of the throat does not come into contact with the inner face 9 of the stopper (FIG. 1), thereby eliminating any reactive force parallel to the throat upon the lugs.

In another form of embodiment (not shown), the lugs are carried by the bottle neck and grooves are formed in the stopper. In other forms of embodiment, the lugs have different shapes from those described above, without however departing from the scope of the invention.

What is claimed is:

1. A stopping apparatus for a bottle having a neck portion formed with a cylindrical throat in a body without symmetry of revolution, said stopping apparatus comprising:

(a) a cylindrical hollow body, one end of which is open, the other end having a radial end wall;

(b) a stopper cap devoid of rotational symmetry;

(c) a cylindrical elastic skirt extending substantially perpendicular to and downwardly from the inner surface of said radial end wall, said cylindrical elastic skirt being positioned concentrically with said radial end wall and being adapted to seal the cylindrical throat of the bottle;

(d) at least one protrusion extending radially inwardly from the inner wall of said cylindrical hollow body;

(e) an annular ring, said annular ring having an upper radially extended edge portion adapted to be spaced downwardly from the upper end of the neck portion of the bottle, said upper radially extended edge forming a bearing surface for slidably receiving the lower end of said at least one protrusion;

(f) at least one groove formed in said annular ring and bordered by radial edges, one end of said groove interrupting said radially extended edge of said annular ring, the other end of said groove opening into a lodging adapted to receive and hold at least one protrusion of said cylindrical hollow body;

(g) two diametrically opposed protrusions extending radially inward from the inner wall of said cylindrical hollow body; and (h) two diametrically opposed grooves adapted to receive, respectively, said two protrusions;

whereby when said stopping apparatus is placed concentrically on the neck portion of the bottle so that the lower end of said at least one protrustion abuts said radially extended edge portion of said annular ring whereby upon rotation of said stopping apparatus, said at least one protrusion is inserted into said at least one groove formed in said annular ring, said radial edges of said at least one groove cooperating with said at least one protrusion to introduce said at least one protrusion into said lodging thereby sealing said bottle when said stopper cap has a predetermined orientation relative to the bottle; and wherein each of said protrusions comprises a prismatic lug having a convex polygonal periphery, each lug having an inwardly facing surface substantially concentric with the inner surface of said cylindrical hollow body, at least one upper facet, at least one lower facet and at least one planar facet facing into the direction of rotation for closure, said at least one planar facet extending substantially parallel to the axis of rotation of said stopping apparatus and said upper and lower facets extending substantially perpendicular thereto.

2. A stopping apparatus according to claim 1, wherein said at least one groove is configured, substantially, as a high pitch spiral.

3. A stopping apparatus according to claim 1, wherein the neck portion of the bottle above said radially extended edge portion of said annular ring has a predetermined diameter and constitutes a guiding surface for said at least one protrusion.

4. A stopping apparatus according to claim 1, wherein each of said lodgings comprises a top portion extending substantially perpendicular to the axis of rotation of said stopping apparatus, a bottom portion extending substantially perpendicular to the axis of rotation of said stopping apparatus and an end wall extending substantially parallel to the axis of rotation, said end wall constituting a stop.

5. A stopping apparatus according to claim 4 wherein said lodging opens out from the end of said groove so as to define at the end a hard point for passage of said lug which the latter crosses by being deformed elastically and beyond which point the lug is locked to an unequivocal position.

6. A stopping apparatus according to claim 1, wherein said bottle is made of glass, said annular ring is integrally formed therewith and said cylindrical hollow body is formed from plastic.

7. A stopping apparatus according to claim 1, wherein said stopper cap is integrally formed with said cylindrical hollow body.

8. A stopping apparatus according to claim 1, wherein said top portion of each of said lodgings is inclined upwardly, in the direction of rotation for closure, to form a corner of transition, said corner being adapted to distort elastically said upper facet of said lug of said inwardly projecting protrusion.

9. A stopping apparatus according to claim 1 in combination with a bottle.

10. A stopping apparatus according to claim 9 wherein said bottle has a body devoid of rotational symmetry, said stopping apparatus being adapted to position said cap on said bottle so as to assure a single angular configuration therebetween when said stopping apparatus seals said bottle.

11. A stopping apparatus according to claim 1, wherein said stopper cap has a cylindrical bore adapted to receive and hold said cylindrical hollow body in a force fit manner.

12. A stopping apparatus for a bottle having a neck portion formed with a cylindrical throat and a body without symmetry of revolution, said stopping apparatus comprising:

(a) a cylindrical hollow body, one end of which is open, the other end of which has a radial end wall;

(b) a stopper cap devoid of rotational symmetry;

(c) a cylindrical elastic skirt extending substantially perpendicular to and downwardly from the inner surface of said radial end wall, said cylindrical elastic skirt being positioned concentrically with said radial end wall and being adapted to seal the cylindrical throat of the bottle;

(d) at least one protrusion extending radially inwardly from the inner wall of said cylindrical hollow body, said protrusion being a prismatic lug having a convex polygonal periphery, said lug having an inwardly facing surface substantially concentric with the inner surface of said hollow body, at least one upper facet extending substantially perpendicular to said axis of rotation of said stopping apparatus at least one lower facet extending substantially perpendicular to said axis of rotaion and at least one planar facet extending substantially perpendicular thereto;

(e) an annular ring, said annular ring having an upper radially extended edge portion adapted to be spaced downwardly from the upper end of the neck portion of the bottle, said upper radially extended edge forming a bearing surface for slidably receiving the lower end of said at least one protrusion;

(f) at least one groove in said annular ring and bordered by radial edges; one end of said groove interrupting said radially extended edge of annular ring, the other end of said groove opening into a lodging adapted to receive and hold said at least one protrusion of said cylindrical hollow body, said lodging comprising a top portion extending substantially perpendicular to the axis of rotation of said stopping apparatus, a lower portion extending substantially perpendicular to the axis of rotation of said stopping apparatus and an end wall constituting a stop;

whereby when said stopping apparatus is placed concentrically on the neck portion of the bottle so that the lower edge of said at least one protrusion abuts said radially extended edge portion of said annular ring whereby upon rotation of said stopping apparatus, said at least one protrusion is inserted into said at least one groove formed in said annular ring, said radial edges of said at least one groove cooperating with said at least one protrusion to introduce said at least one protrusion into said lodging thereby elastically deforming said protrusion to lock said stopping apparatus to an unequivocal position.

* * * * *